US007296510B2

(12) United States Patent
Ohtsuka et al.

(10) Patent No.: US 7,296,510 B2
(45) Date of Patent: Nov. 20, 2007

(54) COOKING DEVICE

(75) Inventors: Masaki Ohtsuka, Osaka (JP); Yukishige Shiraichi, Osaka (JP); Shinya Ueda, Nara (JP); Yasuhiro Sakoda, Wakayama (JP); Mitsuo Hirooka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/492,217

(22) PCT Filed: Oct. 18, 2002

(86) PCT No.: PCT/JP02/10865

§ 371 (c)(1),
(2), (4) Date: Apr. 9, 2004

(87) PCT Pub. No.: WO03/036174

PCT Pub. Date: Jan. 5, 2003

(65) Prior Publication Data

US 2005/0005781 A1 Jan. 13, 2005

(30) Foreign Application Priority Data

Oct. 19, 2001 (JP) ..... 2001-321291
May 20, 2002 (JP) ..... 2002-143969

(51) Int. Cl.
*A23L 1/00* (2006.01)

(52) U.S. Cl. ..... 99/476; 99/330; 219/400; 219/681

(58) Field of Classification Search ..... 99/330, 99/339, 337, 340, 342, 467–473, 474–476, 99/516; 126/20, 369, 21 A, 21 R, 299 R; 219/400, 401, 385, 386, 396, 492, 393, 757, 219/707, 681, 682, 683; 392/492, 360, 400, 392/399, 393, 394; 426/523, 509–511
See application file for complete search history.

(56) References Cited

U.S. PATENT DOCUMENTS 4,308,853 A 1/1982 Thirode (Continued)

FOREIGN PATENT DOCUMENTS

JP 61-74018 5/1986

(Continued)

OTHER PUBLICATIONS

European Search Report for corresponding Application No. 02777892.7 dated Sep. 30, 2005.

*Primary Examiner*—Timothy F. Simone
(74) *Attorney, Agent, or Firm*—Renner, Otto, Boiselle & Sklar, LLP

(57) ABSTRACT

A cooking device, wherein, when a roast chicken is selected from a menu displayed on an operating part (81), a centrifugal fan (51) is controlled so as to be rotated in forward direction at a high speed to blow out hot air with a speed of 65 km/h or faster from upper blowout ports (71) and hot air with a speed of 30 km/h or slower from side blowout ports (72) whereby a roast chicken in a heating chamber (3) can be cooked at the high speed and, when a sponge cake is selected from the menu, the centrifugal fan (51) is controlled so as to be rotated in reverse direction at a low speed to blow out hot air with a speed of 30 km/h or slower from the upper blowout ports (71) and hot air with a speed of 40 km/h or slower from the side blowout ports (72) whereby a sponge cake in the heating chamber (3) can be cooked light and fluffy.

6 Claims, 10 Drawing Sheets

U.S. PATENT DOCUMENTS

| | | | | |
|---|---|---|---|---|
| 4,462,383 | A * | 7/1984 | Henke et al. | 126/21 A |
| 5,417,148 | A * | 5/1995 | Cavallo | 99/334 |
| 5,423,248 | A * | 6/1995 | Smith et al. | 99/443 C |
| 5,694,835 | A * | 12/1997 | Mangina | 99/468 |
| 5,746,118 | A * | 5/1998 | Brunner et al. | 99/427 |
| 5,865,108 | A * | 2/1999 | Montagnino et al. | 99/476 |
| 6,218,650 | B1 | 4/2001 | Tsukamoto et al. | |
| 6,279,464 | B1 * | 8/2001 | Lo et al. | 99/331 |
| 6,318,246 | B2 * | 11/2001 | Fukushima et al. | 99/330 |
| 6,346,691 | B2 * | 2/2002 | Kim et al. | 219/681 |
| 6,517,882 | B2 * | 2/2003 | Elia et al. | 426/523 |
| 6,572,911 | B1 * | 6/2003 | Corcoran et al. | 426/510 |
| 6,730,881 | B1 * | 5/2004 | Arntz et al. | 219/400 |
| 6,732,637 | B2 * | 5/2004 | Artt | 99/476 |
| 6,813,992 | B2 * | 11/2004 | Blumel et al. | 99/330 |
| 2003/0000515 | A1 | 1/2003 | Cole et al. | |

FOREIGN PATENT DOCUMENTS

| | | |
|---|---|---|
| JP | 2-503386 | 10/1990 |
| JP | 4-1311 | 1/1992 |
| JP | 6-281148 | 10/1994 |
| JP | 8-256917 | 10/1996 |
| JP | 9-503334 | 3/1997 |
| JP | 9-126463 | 5/1997 |
| JP | 9-126464 | 5/1997 |
| JP | 10-290752 | 11/1998 |
| JP | 11-108368 | 4/1999 |
| JP | 11-515085 | 12/1999 |
| JP | 2000-104924 | 4/2000 |
| JP | 2000-329351 | 11/2000 |

* cited by examiner

COOKING DEVICE

BACKGROUND OF THE INVENTION (1) Field of the Invention

The present invention relates to a cooking device, such as a convection oven or a hot-air-impact oven, for cooking a cooking target with heat.

(2) Description of Related Art

A cooking device 100 known as a convection oven for cooking a cooking target with heat is typically constructed as shown in FIG. 17. FIG. 17 is a diagram showing an outline of the construction of such a conventional cooking device 100. In FIG. 17, the cooking device 100 is composed of: a box-shaped member 2 that is thermally insulated; a heating chamber 3 that is formed inside the box-shaped member 2 to permit a cooking target to be placed therein; heating means 4 that heats the cooking target placed in the heating chamber 3; and blowing means 5. The blowing means 5 is provided with a blowing machine 54, which is composed of: a centrifugal fan 51; a drive motor 52 that drives the centrifugal fan 51; and a fan casing 53 that communicates with the heating chamber 3 through a suction port 6 and a blowoff port 7 and on which the centrifugal fan 51 is pivoted. The hot air heated by the heating means 4 is introduced into the heating chamber 3 by the blowing means 5 so that the air inside the heating chamber 3 is heated and circuited in such a way as to make the temperature inside the heating chamber 3 uniform and thereby cook the cooking target with heat.

Conventional cooking devices of this type are disclosed, for example, in Japanese Utility Model Published No. H6-23841 and Japanese Patent Application Laid-Open No. 2000-329351. The cooking devices disclosed in these publications both adopt a cooking method whereby the air inside a heating chamber is heated and circulated in such a way as to make the temperature inside the heating chamber uniform and thereby cook a cooking target with heat (hereinafter, this method will be referred to as the hot-wind-circulation method).

This cooking method, however, has the disadvantage of requiring rather a long time for cooking. The time required for cooking can be shortened by increasing the rotation rate of the centrifugal fan so as to increase the wind volume, and by increasing the amount of heat generated by the heater. This, however, results in not only greatly increased power consumption but also greatly increased noise, which constitutes a critical drawback.

On the other hand, Japanese Patent Application Laid-Open No. H9-503334 discloses a cooking device that adopts, instead of the hot-wind-circulation method mentioned above, a cooking method whereby the air heated by heating means is blown directly at a cooking target so as to cook the cooking target with heat (hereinafter, this method will be referred to as the hot-air-impact method).

The hot-wind-circulation method and the hot-air-impact method differ from each other in that, whereas the former operates blowing means for the purpose of making the temperature inside a heating chamber uniform and, by using the thus uniformized heat, applies heat uniformly to a cooking target, the latter blows hot air at a cooking target from a predetermined direction and, by using the hot air, cooks the cooking target with heat.

In the hot-air-impact method, cooking is achieved by making the hot air heated by a heater hit a cooking target at a high speed by the action of a blowing machine. This helps greatly reduce the time required for cooking without unduly increasing the power consumption by the heater.

Indeed, the hot-air-impact method is very suitable for the cooking of a chunk of meat is not interfered with by the wind pressure of a hot air impact. However, the hot-air-impact method is unsuitable for the cooking of sponge cake or the like, i.e., a cooking target that is cooked by producing bubbles therein, or a cooking target that contains much air. The reason is that, inconveniently, the wind pressure of a hot air impact causes such a cooking target to become unacceptably deformed, unduly hard, or charred at the surface, and thereby interferes with the cooking thereof.

An object of the present invention is to provide a cooking device that, alone, permits the use of a plurality of cooking methods so as to be capable of cooking any type of cooking target.

BRIEF SUMMARY OF THE INVENTION

To achieve the above object, according to one aspect of the present invention, a cooking device is provided with a box-shaped member, a heating chamber that is formed inside the box-shaped member to permit a cooking target to be placed therein, a first and a second heating device for heating the cooking target placed in the heating chamber, reversibly rotatable fan for introducing the hot air heated by the first and second heating devices into the heating chamber, a controller for controlling the first and second heating devices and the fan, a suction port formed in a wall surface of the heating chamber, a first and a second blowoff port formed respectively in different wall surfaces of the heating chamber, and a branch air-blow passage that branches air that has been sucked in via the suction port by rotation of the fan in a first blowoff port direction and a second blowoff port direction. Here, cooking is performed by a plurality of cooking methods based on the fan, by being rotated in a forward or reverse direction, adjusting individually a wind volume of the air heated by the first heating device and introduced via the first blowoff port into the heating chamber and a wind volume of the air heated by the second heating device and introduced via the second blowoff port into the heating chamber.

In this construction, a single cooking device is permitted to perform cooking by a plurality of different types of cooking method. The plurality of different types of cooking method are, for example, the hot-air-impact method and the hot-wind-circulation method. The former is a cooking method whereby, for example, with the fan rotated in a forward direction at a high speed, hot air is blown out via the first blowoff port at a speed of 65 km/h or more and hot air is blown out via the second blowoff port at a speed of 30 km/h or less, and the latter is a cooking method whereby, with the fan rotated in a reverse direction at a low speed, hot air is blown out via the first blowoff port at a speed of 30 km/h or less and hot air is blown out via the second blowoff port at a speed of 40 km/h or less.

Accordingly, by appropriately devising a control method by which to cook a particular cooking target, it is possible to realize, on a single cooking device, both a cooking method that is suitable for the cooking of a chunk of meat such as chicken to be roasted, or pizza, or the like, i.e., a cooking target of which the cooking is not interfered with by the wind pressure of a hot air impact and a cooking method that is suitable for the cooking of sponge cake or the like, i.e., a cooking target that is cooked by producing bubbles therein, or a cooking target that contains much air. Moreover, since a plurality of cooking methods can be realized with a single blowing machine, it is possible to reduce the cost of the cooking machine.

Here, the wind volume of the air heated by the first heating device and introduced via the first blowoff port into the heating chamber and the wind volume of the air heated by the second heating device and introduced via the second blowoff port into the heating chamber are adjusted individually in one of the following manners. The branch air-blow passage is built with a two-way branch duct that branches in the first blowoff port direction and the second blowoff port direction, and at the branch point of the two-way branch duct is provided wind volume adjusting means for adjusting the wind volumes branched in two directions. Alternatively, the branch air-blow passage is built with a two-way branch fan casing that branches in the first blowoff port direction and the second blowoff port direction, and the wind volumes branched in two directions are adjusted by the controller controlling the fan rotation rate and/or the fan rotation direction of the fan.

Preferably, the first blowoff port is formed in the surface that faces the surface on which the cooking target is placed, the second blowoff port is formed in another surface, and the air-blow passage that connects the suction port to the first blowoff port and the air-blow passage that connects the suction port to the second blowoff port branch from the fan in two directions so as to each describe an L-like or otherwise angled shape.

In this construction, as a result of the fan driving means adjusting the rotation rate and switching the rotation direction, it is possible to change not only the wind volumes blown out via the two blowoff ports but also the ratio of the wind speeds at the two blowoff ports. Specifically, when the fan is rotating in one direction, the wind volume and/or the wind speed at one blowoff port is higher than the wind volume and/or the wind speed at the other blowoff port; when the fan is rotating in the opposite direction, the wind volume and/or the wind speed at the former blowoff port is lower than the wind volume and/or the wind speed at the latter blowoff port.

A cooking device that permits air to be blown in the manner described above can be realized without the use of a special device. Thus, it is possible to very inexpensively manufacture a cooking device that, alone, realizes a plurality of cooking methods having utterly different effects from one another.

Preferably, the air-blow passage that connects the suction port to the first blowoff port is formed so as to run from the fan in the direction in which is located the surface that faces the surface on which the cooking target is placed.

In this construction, when the fan is rotating in one direction, the wind volume and/or the wind speed at the first blowoff port is higher than the wind volume and/or the wind speed at the second blowoff port; when the fan is rotating in the opposite direction, the wind volume and/or the wind speed at the first blowoff port is lower than the wind volume and/or the wind speed at the second blowoff port.

Accordingly, by using the former blowing method, it is possible to perform cooking chiefly by the hot-air-impact method. For example, it is possible to blow hot air at high speed at a chunk of meat such as chicken to be roasted, or pizza, or the like so as to perform cooking by a cooking method suitable for a cooking target of which the cooking is promoted by a hot air impact. On the other hand, by using the latter blowing method, it is possible to perform cooking by a cooking method suitable for sponge cake or the like, i.e., a cooking target that is cooked by producing bubbles therein, or a cooking target that contains much air from the beginning, that is, collectively, a cooking target of which the cooking is interfered with by a hot air impact. In this way, it is possible to easily realize, on a single cooking device, different cooking methods suitable respectively for different types of cooking target having utterly different properties from one another as described above.

Preferably, the air-blow passage that connects the suction port to the first blowoff port becomes increasingly large along the air-blow direction.

In this construction, when the wind volume and/or the wind speed of the air that flows through the air-blow passage that connects the suction port to the first blowoff port is higher than the wind volume and/or the wind speed of the air that flows through the air-blow passage that connects the suction port to the second blowoff port, since the former air-blow passage becomes increasingly large along the air-blow direction, this air-blow passage functions as a so-called diffuser by converting the kinetic energy of the wind flowing therethrough into a static pressure. This augments the wind that is guided to the air-blow passage that connects the suction port to the first blowoff port. On the other hand, when the wind volumes and/or the wind speeds have the opposite relationship, since the air-blow passage that connects the suction port to the first blowoff port becomes increasingly large along the air-blow direction, the wind is separated from the wall surface of this air-blow passage, and thus a so-called choking phenomenon occurs. This diminishes the wind that is guided to the air-blow passage that connects the suction port to the first blowoff port. That is, the former state helps augment the impact of the hot air that is blown at the cooking target at a high speed from the direction in which is located the surface that faces the surface on which the cooking target is placed, and the latter state helps diminish the speed of the wind that is blown at the cooking target from the direction in which is located the surface that faces the surface on which the cooking target is placed. This makes it possible, in a case where a chunk of meat such as chicken to be roasted, or pizza, or the like, i.e., a cooking target of which the cooking is promoted by a hot air impact when hot air is blown at a high speed at it, is cooked, to further shorten the time needed for cooking and, in a case where sponge cake or the like, i.e., a cooking target that is cooked by producing bubbles therein, or a cooking target that contains much air from the beginning, that is, collectively, a cooking target of which the cooking is interfered with by a hot air impact, is cooked, to perform cooking by a more suitable method.

Preferably, the air-blow passage that connects the suction port to the first blowoff port has a larger cross-sectional area than the other air-blow passage.

In this construction, when the fan is rotating in one direction, the air volume and/or the wind speed of the air blown out via the first blowoff port is much higher than the air volume and/or the wind speed of the air blown out via the second blowoff port; when the fan is rotating in the opposite direction, the air volume and/or the wind speed of the air blown out via the first blowoff port is slightly lower than the air volume and/or the wind speed of the air blown out via the second blowoff port. Thus, with almost no degradation in the cooking performance with which cake or the like, i.e., a cooking target that is cooked by producing bubbles therein, or a cooking target that contains much air from the beginning, that is, collectively, a cooking target of which the cooking is interfered with by a hot air impact, is cooked, it is possible to greatly enhance the cooking performance with which a chunk of meat such as chicken to be roasted, or pizza, or the like, i.e., a cooking target of which the cooking is promoted by a hot air impact when hot air is blown at a high speed at it, is cooked. Thus, it is possible either to further shorten the time needed for cooking, or to greatly reduce the noise produced during cooking.

DETAILED DESCRIPTION OF THE INVENTION

Figure 1:
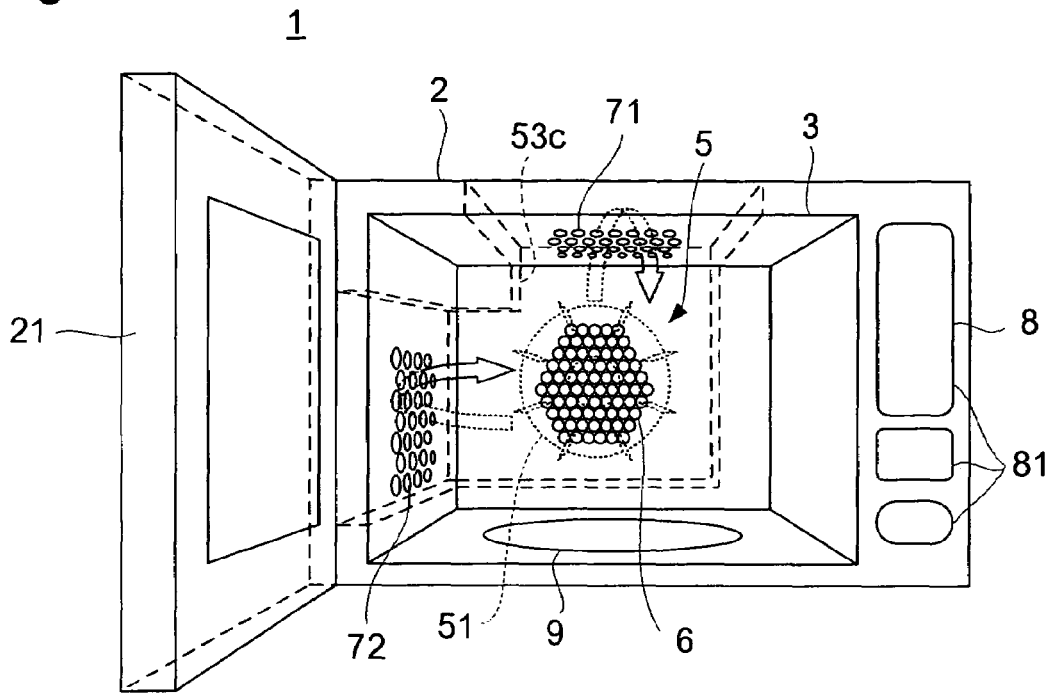
FIG. 1 is a partially see-through perspective view showing the construction of the cooking device of a first embodiment of the invention, with the thermally insulated door opened.

Hereinafter, embodiments of the present invention will be described with reference to the drawings. It should be noted that such components as are identical or equivalent between different embodiments are identified with the same reference numerals.

Figure 2:
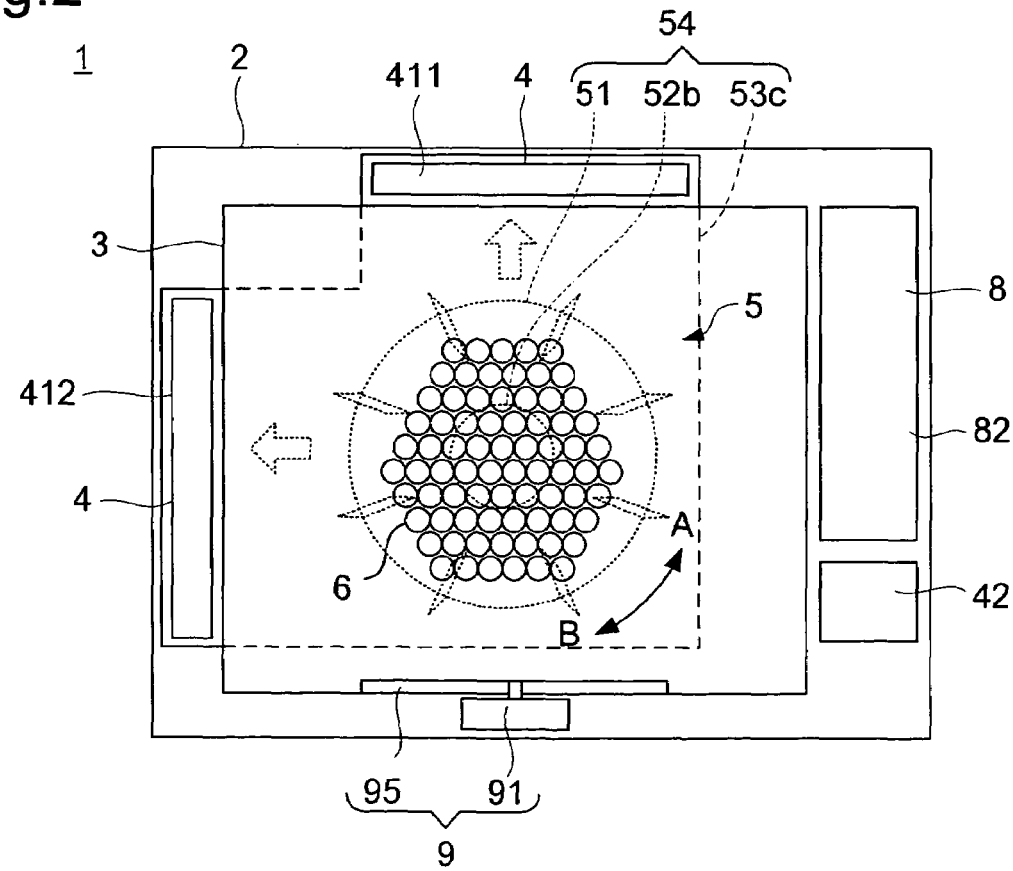
FIG. 2 is a sectional view of the same cooking device.

First, a first embodiment of the invention will be described. FIG. 1 is a partially see-through perspective view showing the construction of the cooking device 1 of the first embodiment, with the thermally insulated door 21 opened, and FIG. 2 is a sectional view of the same cooking device 1. The cooking device 1 is composed of: a box-shaped member 2 that is thermally insulated and that has an opening formed in the front surface thereof; a heating chamber 3 that is formed inside the box-shaped member 2 to permit a cooking target to be placed therein; heating means 4 that heats the cooking target; blowing means 5 that sends the hot air heated by the heating means 4 into the heating chamber 3; controlling means 8 that controls the heating means and/or the blowing means 5; and rotating means 9 that rotates the cooking target.

On the front surface of the box-shaped member 2, there are provided a thermally insulated door 21 that openably closes the opening formed in that surface, and an operation panel 81 that accepts instructions from the user.

On the floor surface of the heating chamber 3, there is provided, as the rotating means 9 for rotating the cooking target, a turntable 95. The turntable 95 is rotated by a drive motor 91, permits a rotary dish, meshed rack, or double-stage rack to be placed interchangeably thereon, and can rotate along therewith.

The blowing means 5 is built with a blowing machine 54, which is composed of: a centrifugal fan 51; a reversible motor **52*b* that drives the centrifugal fan 51 and that can rotate in the forward and reverse directions; a two-way branch fan casing 53*c* on which the centrifugal fan 51 is pivoted and that branches in the direction of a ceiling-surface blowoff port 71 and in the direction of a side-surface blowoff port 72. The hot air heated by a first heater 411 provided as the heating means 4 is introduced into the heating chamber 3 via the ceiling-surface blowoff port 71, and the hot air heated by a second heater 412 is introduced into the heating chamber 3 via the side-surface blowoff port 72. The reversible motor 52*b* rotates at a high rate in the direction indicated as "A" in FIG. 2, and rotates at a low rate in the direction indicated as "B" in FIG. 2**.

A suction port 6 and the side-surface blowoff port 72 each consist of a plurality of punched holes each 5 mm across. The ceiling-surface blowoff port 71 consists of a plurality of nozzles each 11 mm across.

As the heating means, there is provided, in addition to the first an second heaters 411 and 412, an induction heating device 42 for assisting cooking.

In the cooking device 1 constructed as described above, when the user puts a cooking target on a meshed rack (not illustrated) placed on the turntable 95 and enters instructions via the operation panel 81, according to the instructions entered via the operation panel 81, a controller 82 provided as the controlling means 8 selects a suitable cooking method from a plurality of preprogrammed cooking methods, and controls the operation of the reversible motor **52*b* of the blowing machine 54, the first and second heaters 411 and 412, the induction heating device 42, and the turntable drive motor 91** to perform the cooking of the cooking target.

For example, in a case where roasted chicken is prepared on the cooking device 1 of this embodiment, a meshed rack (not illustrated) is placed on the turntable 95 inside the heating chamber 3, then a chunk of chicken is put on the meshed rack, and then, from the menu items displayed on the operation panel 81, the one for roasted chicken is selected. In response to this instruction, the controller 82 operates the reversible motor **52*b* of the blowing machine 54, the first and second heaters 411 and 412, the induction heating device 42, and the turntable drive motor 91. Specifically, in this case, the centrifugal fan 51 is rotated by the reversible motor 52*b* at a high rate in the direction indicated by arrow A in FIG. 2, so that hot air is blown out via the ceiling-surface blowoff port 71 at a speed of 65 km/h or more, and that hot air is blown out via the side-surface blowoff port 72 at a speed of 30 km/h or less. This control permits a hot-air-impact cooking method, and thus permits quick preparation of roasted chicken. The induction heating device 42** may be energized to assist cooking.

On the other hand, in a case where sponge cake is prepared on the cooking device 1 of this embodiment, a double-stage rack (not illustrated) is placed on the turntable 95 inside the heating chamber 3, then a lump of dough is put on each stage of the double-stage rack, and then, from the menu items displayed on the operation panel 81, the one for sponge cake is selected. In response to this instruction, the controller 82 operates the reversible motor 52*b* of the blowing machine 54, the second heater 412, the induction heating device 42, and the turntable drive motor 91, and, as necessary, operates the first heater 411. Specifically, in this case, the centrifugal fan 51 is rotated by the reversible motor 52*b* at a low rate in the direction indicated by arrow B in FIG. 2, so that hot air is blown out via the ceiling-surface blowoff port 71 at a speed of 30 km/h or less, and that hot air is blown out via the side-surface blowoff port 72 at a speed of 40 km/h or less. This control permits a double-stage hot-wind-circulation cooking method, and thus permits preparation of fluffy sponge cake on each stage of the double-stage rack.

The above-described two cooking methods having utterly different effects are realized by individually controlling and appropriately selecting from or combining together the wind speeds at the plurality of blowoff ports formed in different wall surfaces of the heating chamber. That is, the two blowoff ports may be arranged in a different manner than illustrated in the figure; for example, they may be arranged in the ceiling and rear surfaces, in the ceiling and front surfaces, in the floor and side surfaces, in the floor and rear surfaces, or in the floor and front surfaces. It is possible even to arrange at least one of two or more blowoff ports in a wall surface different from the wall surface in which the other blowoff ports are formed. With any of these arrangements, it is possible to obtain almost the same effects. Accordingly, although the two blowoff ports are arranged in the ceiling and side surfaces in the cooking device 1 of this embodiment, this is not meant to limit in any way how many blowoff ports should be formed and where they should be arranged.

The rotation rate of the reversible motor 52*b* of the blowing machine 54 is variable, and therefore cooking can be performed at a wind speed other than those specifically given above. The first and second heaters 411 and 412 and the induction heating device 42 can be turned on and off, and the amounts of heat generated by them can be adjusted. This make it possible to realize different cooking methods suitable for the cooking of various cooking targets.

The blowing machine 54 may use, as the centrifugal fan 51, a sirocco fan, radial fan, or turbo fan, or, to make the best of a limited space or out of other consideration, an axial-flow fan, inclined-flow fan, or through-flow fan. The blowing machine 54 may be replaced with a blower. The shape of the fan casing 53 may be rectangular, spiral, or arc-shaped, so long as it can branch an air flow in two directions.

The punched holes of the suction port 6 and the side-surface blowoff port 72 may be given any other diameter than 5 mm to obtain the same effects. Those holes do not have to be formed as punched holes, but may be formed as slits or a net. The same is true with the ceiling-surface blowoff port 71; that is, the holes there may be given any other diameter than 11 mm to obtain the same effects.

Figure 3:
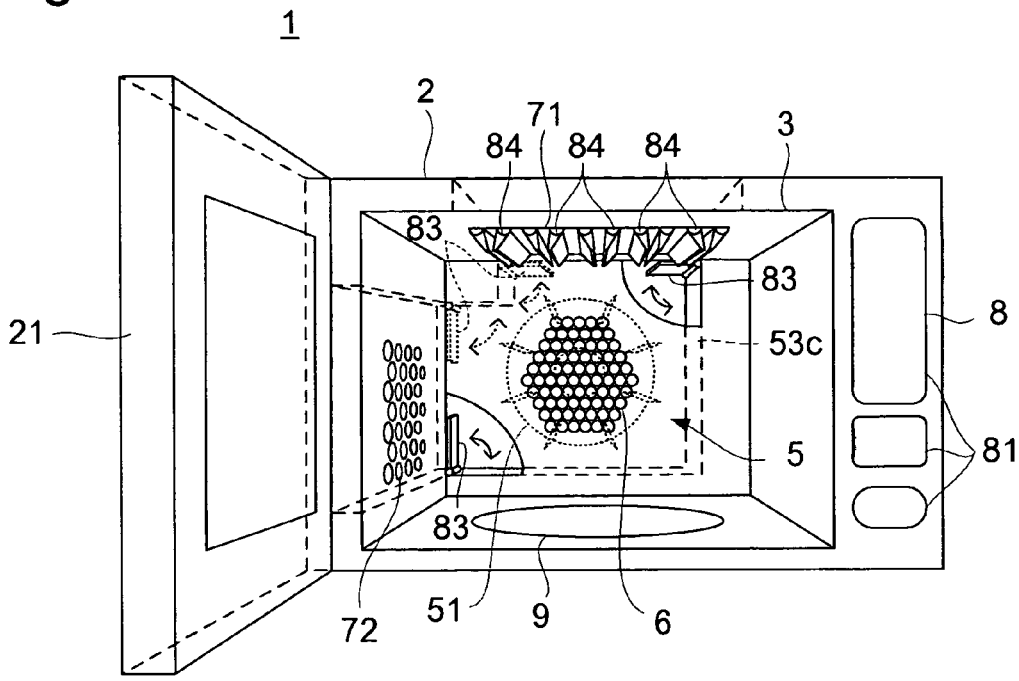
FIG. 3 is a partially see-through perspective view showing the construction of the cooking device of a second embodiment of the invention, with the thermally insulated door opened.
Figure 4:
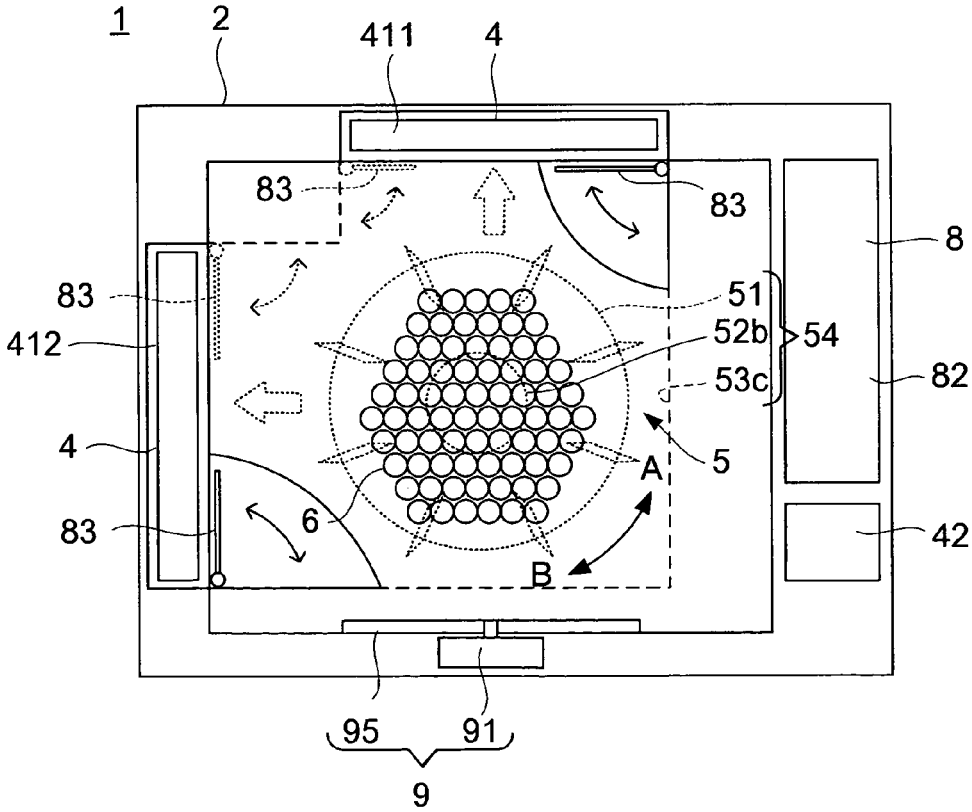
FIG. 4 is a sectional view of the same cooking device.

Next, a second embodiment of the invention will be described. FIG. 3 is a partially see-through perspective view showing the construction of the cooking device 1 of the second embodiment, with the thermally insulated door 21 opened, and FIG. 4 is a sectional view of the same cooking device 1. The cooking device 1 of this embodiment differs from the cooking device 1 of the first embodiment shown in FIGS. 1 and 2 in the following respects.

Inside the two-way branch fan casing 53*c*, there is provided a damper device 83. The damper device 83 permits adjustment of the wind volumes sent from the blowing machine 54 in the direction of the ceiling-surface blowoff port 71 and in the direction of the side-surface blowoff port 72. Moreover, at the ceiling-surface blowoff port 71, there is provided a throttling device 84. The throttling device 84 permits adjustment of the wind speed blown out via the ceiling-surface blowoff port 71. In other respects, the cooking device 1 of this embodiment is constructed in the same manner as the cooking device 1 of the first embodiment, and therefore such components as are common to the two embodiments are identified with the same reference numerals, and their explanations will not be repeated.

Constructed as described above, the cooking device 1 of this embodiments offers the same effects as the cooking device 1 of the first embodiment. In addition, in this embodiment, by controlling the damper device 83 provided inside the fan casing 53*c* and the throttling device 84 provided at the ceiling-surface blowoff port 71, it is possible to easily adjust the wind speeds blown out via the ceiling-surface and side-surface blowoff ports 71 and 72, and to more finely control the wind speeds. Moreover, since the wind speeds can be finely adjusted during cooking, it is no longer necessary to strictly determine, at the design stage, the wind volumes branched into the two directions of the two-way branch fan casing 53*c*. This helps greatly simplify the design of the two-way branch fan casing 53*c*, and thus helps reduce the production cost.

Figure 5:
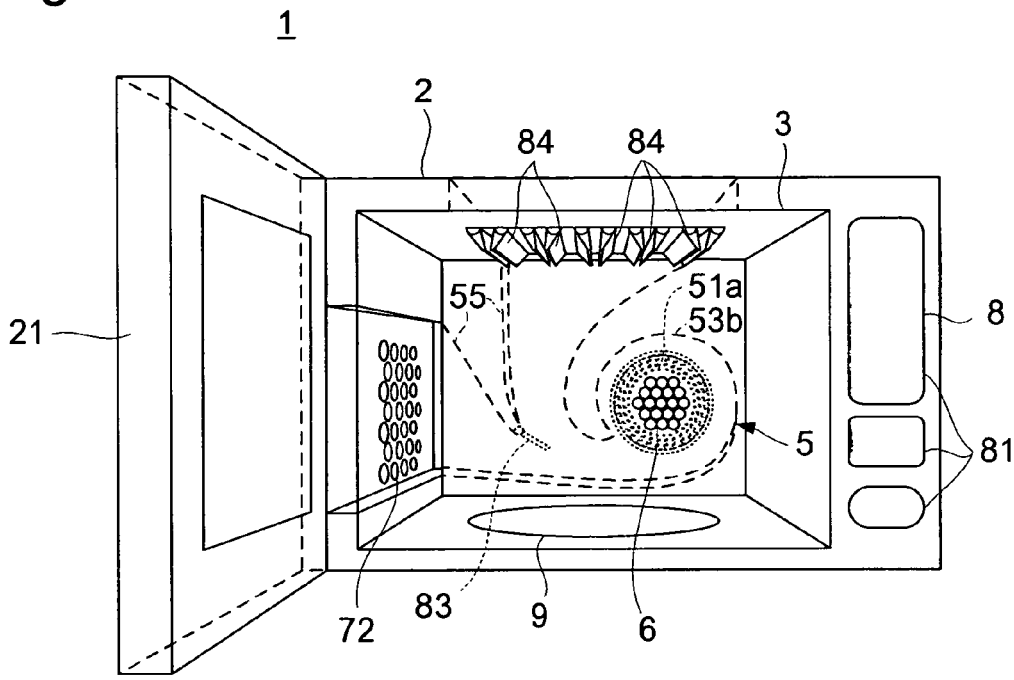
FIG. 5 is a partially see-through perspective view showing the construction of the cooking device of a third embodiment of the invention, with the thermally insulated door opened.
Figure 6:
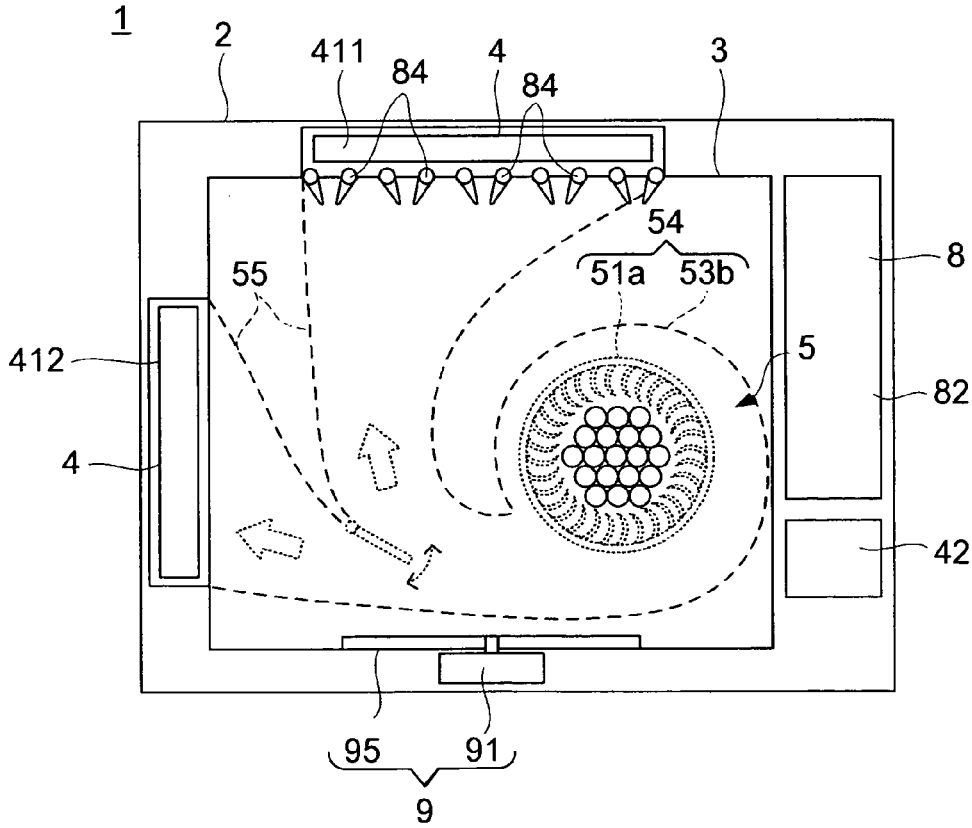
FIG. 6 is a sectional view of the same cooking device.

Next, a third embodiment of the invention will be described. FIG. 5 is a partially see-through perspective view showing the construction of the cooking device 1 of the third embodiment, with the thermally insulated door 21 opened, and FIG. 6 is a sectional view of the same cooking device 1. The cooking device 1 of this embodiment differs from the cooking device 1 of the first embodiment shown in FIGS. 1 and 2 in the following respects.

The blowing machine 54 is composed of: a sirocco fan 51*a*; a drive motor (not illustrated) that drives the sirocco fan 51*a* and that rotates only in one direction; and a spiral fan casing 53*b* that blows off air only in one direction. The outlet of the spiral fan casing 53*b* communicates with a two-way branch duct 55, and thus the air sent from the blowing machine 54 is branched by the two-way branch duct 55 in the direction of the ceiling-surface blowoff port 71 and in the direction of the side-surface blowoff port 72. At the branch point of the two-way branch duct 55, there is provided a rotary damper device 83, and this damper device 83 permits adjustment of the wind volumes sent from the blowing machine 54 in the direction of the ceiling-surface blowoff port 71 and in the direction of the side-surface blowoff port 72. Moreover, at the ceiling-surface blowoff port 71, there is provided a throttling device 84, and this throttling device 84 permits adjustment of the wind speed blown out via the ceiling-surface blowoff port 71. In other respects, the cooking device 1 of this embodiment is constructed in the same manner as the cooking device 1 of the first embodiment, and therefore such components as are common to the two embodiments are identified with the same reference numerals, and their explanations will not be repeated.

Constructed as described above, the cooking device 1 of this embodiments offers the same effects as the cooking device 1 of the first embodiment. In addition, in this embodiment, the blowing machine 54 is built with a sirocco fan 51*a* and a spiral fan casing 53*b*. This helps enhance the blowing efficiency of the blowing machine 54 and reduce the noise it produces. Furthermore, the fan drive motor is a motor that rotates only in one direction. This helps increase efficiency and reduce cost. Moreover, by controlling the damper device 83 provided in the two-way branch duct 55 and the throttling device 84 provided at the ceiling-surface blowoff port 71, it is possible not only to easily adjust the wind speeds blown out via the ceiling-surface and side-surface blowoff ports 71 and 72 but also to more finely adjust the wind speeds.

Figure 7:
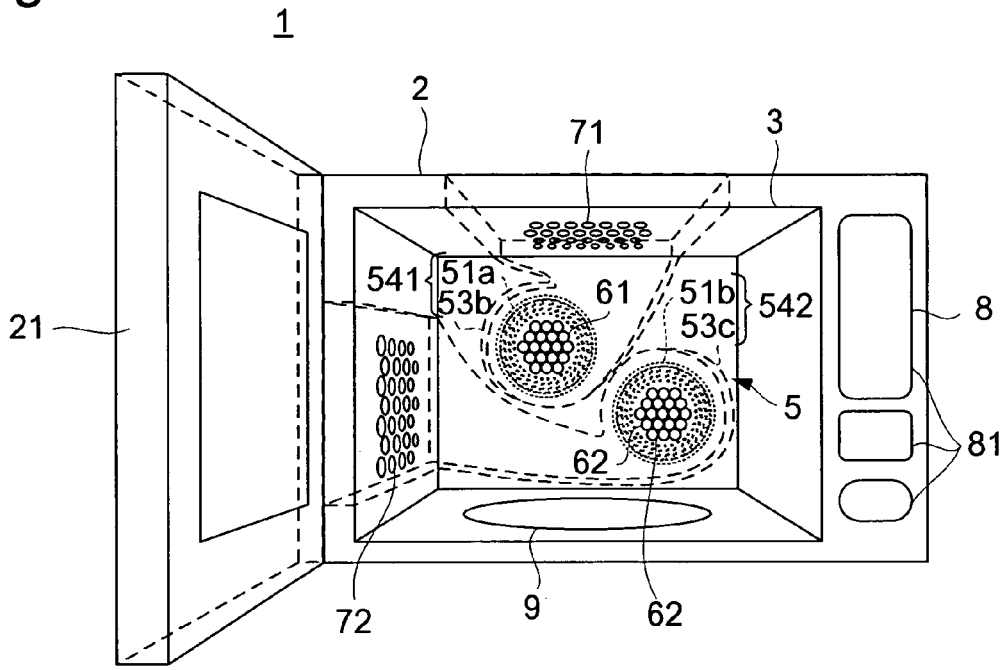
FIG. 7 is a partially see-through perspective view showing the construction of the cooking device of a fourth embodiment of the invention, with the thermally insulated door opened.
Figure 8:
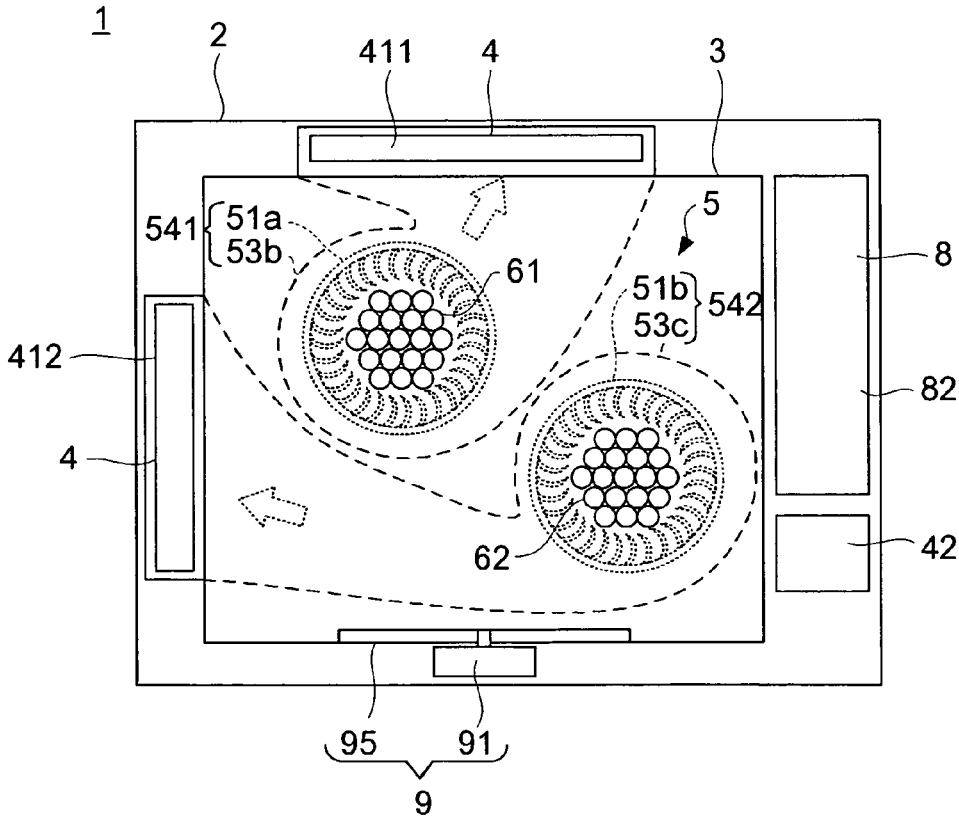
FIG. 8 is a sectional view of the same cooking device.

Next, a fourth embodiment of the invention will be described. FIG. 7 is a partially see-through perspective view showing the construction of the cooking device 1 of the fourth embodiment, with the thermally insulated door 21 opened, and FIG. 8 is a sectional view of the same cooking device 1. The cooking device 1 of this embodiment differs from the cooking device 1 of the first embodiment shown in FIGS. 1 and 2 in the following respects.

The blowing means 5 is built with two blowing machines, namely a first blowing machine 541 and a second blowing machine 542. The first blowing machine 541 is composed of: a sirocco fan 51*a*; a drive motor (not illustrated) that drives the sirocco fan 51*a* and that rotates only in one direction; and a spiral fan casing 53*b* that commutates with the heating chamber 3 via a first blowoff port 61 and via the ceiling-surface blowoff port 71 and that blows off air only in one direction. The second blowing machine 542 is composed of: a sirocco fan 51*b*; a drive motor (not illustrated) that drives the sirocco fan 51*b* and that rotates only in one direction; and a spiral fan casing 53*c* that communicates with the heating chamber 3 via a second blowoff port 62 and via the side-surface blowoff port 72 and that blows off air only in one direction. In other respects, the cooking device 1 of this embodiment is constructed in the same manner as the cooking device 1 of the first embodiment, and therefore such components as are common to the two embodiments are identified with the same reference numerals, and their explanations will not be repeated.

Constructed as described above, the cooking device 1 of this embodiments offers the same effects as the cooking device 1 of the first embodiment. In addition, in this embodiment, the first and second blowing machines 541 and 542 are built with sirocco fans 51*a* and 51*b* and spiral fan casings 53*b* and 53*c*, respectively. This helps increase blow efficiency and reduce noise. Furthermore, the fan drive motor is a motor that rotates only in one direction. This helps increase efficiency and reduce cost. Moreover, the wind speeds blown out via the ceiling-surface and side-surface blowoff ports 71 and 72 can be adjusted simply by controlling the rotation rates of the first and second blowing machines 541 and 542. This makes it possible to very easily adjust the wind speeds blown out via the ceiling-surface and side-surface blowoff ports 71 and 72.

Figure 9:
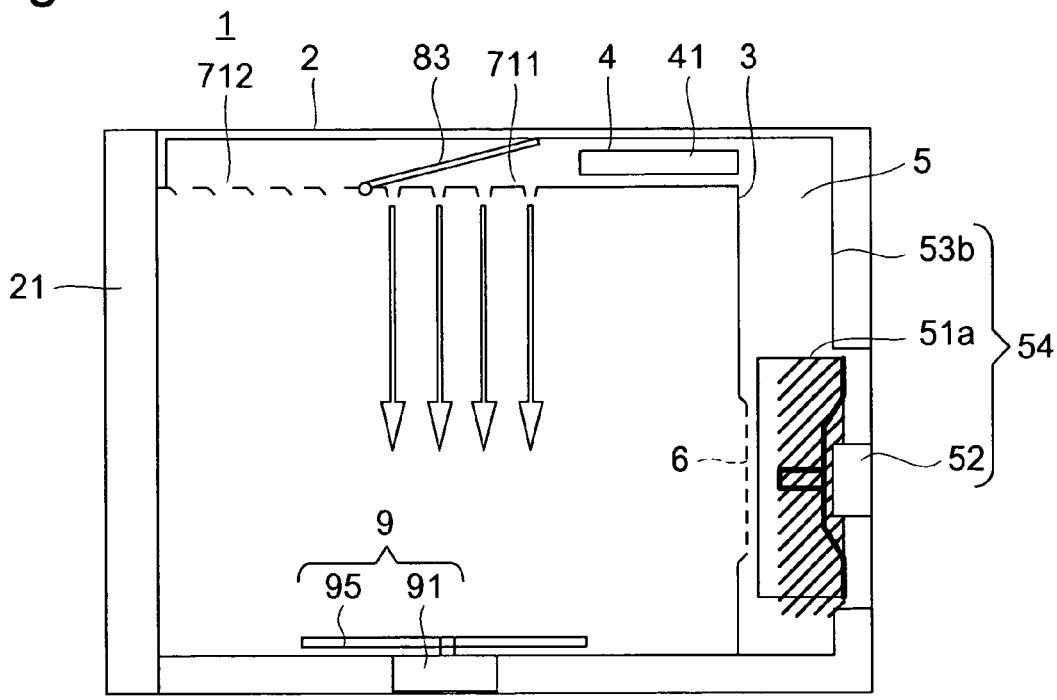
FIG. 9 is a side sectional view showing the construction of the cooking device of a fifth embodiment of the invention, with the thermally insulated door opened.
Figure 10:
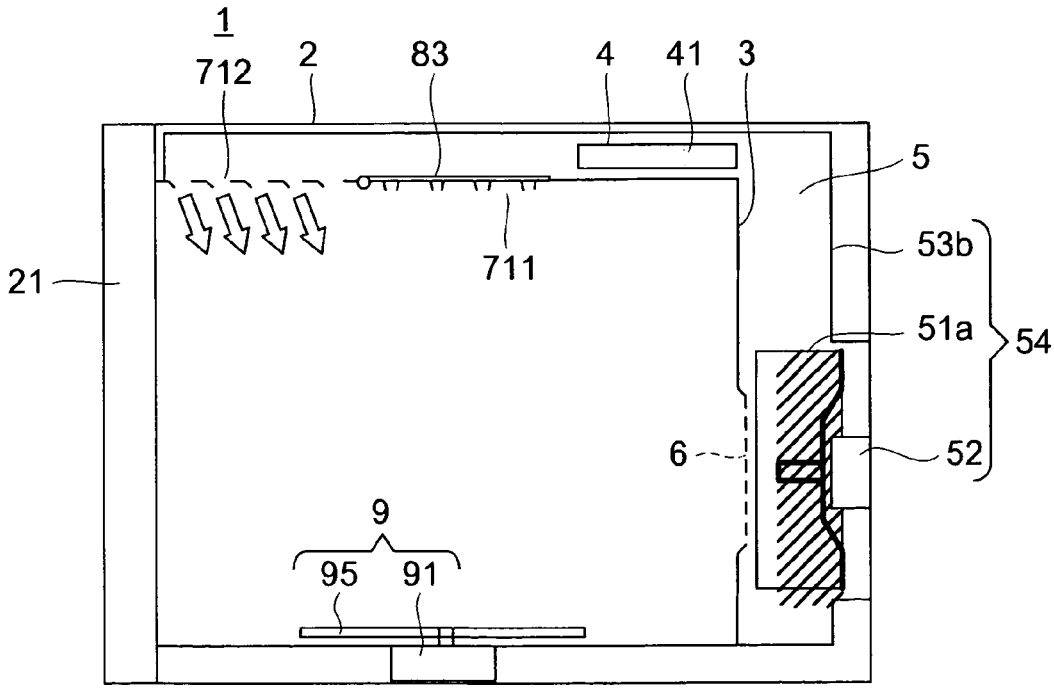
FIG. 10 is a side sectional view illustrating the operation of the same cooking device.

Next, a fifth embodiment of the invention will be described. FIG. 9 is a side sectional view showing the construction of the cooking device 1 of the fifth embodiment, and FIG. 10 is a side sectional view illustrating the operation of the same cooking device 1. The cooking device 1 of this embodiment differs from the cooking device 1 of the first embodiment shown in FIGS. 1 and 2 in the following respects.

The blowing means 5 is built with a blowing machine 54, which is composed of: a sirocco fan 51*a*; a drive motor (not illustrated) that drives the sirocco fan 51*a* and that rotates only in one direction; and a spiral fan casing 53*b* that communicates with the heating chamber 3 via a blowoff port 6 and via a first ceiling-surface blowoff port 711 or a second ceiling-surface blowoff port 712 and that blows off air only in one direction, and a damper device 83 that switches between the first and second ceiling-surface blowoff ports 711 and 722 as the blowoff port via which the air sent from the sirocco fan 51*a* is blown into the heating chamber 3. The hot air heated by a heater 41 provided as the heating means 4 is introduced into the heating chamber 3 via whichever of the first and second ceiling-surface blowoff ports 711 and 722 is chosen by the damper device 83. In other respects, the cooking device 1 of this embodiment is constructed in the same manner as the cooking device 1 of the first embodiment, and therefore such components as are common to the two embodiments are identified with the same reference numerals, and their explanations will not be repeated.

In the cooking device 1 constructed as described above, when the user puts a cooking target on a meshed rack (not illustrated) placed on the turntable 95 and enters instructions via the operation panel 81 (see FIG. 1), according to the instructions entered via the operation panel 81, the controller 82 (see FIG. 2) provided as the controlling means 8 (see FIG. 1) selects a suitable cooking method from a plurality of preprogrammed cooking methods, and controls the operation of the drive motor 52 of the blowing machine 54, the heater 41, the induction heating device 42 (see FIG. 2), and the turntable drive motor 91 to perform the cooking of the cooking target.

For example, in a case where roasted chicken is prepared on the cooking device 1 of this embodiment, a meshed rack (not illustrated) is placed on the turntable 95 inside the heating chamber 3, then a chunk of chicken is put on the meshed rack, and then, from the menu items displayed on the operation panel 81 (see FIG. 1), the one for roasted chicken in selected. In response to this instruction, the controller 82 (see FIG. 2) instructs the damper device 83 to switch the blowoff port of the blowing machine 54 to the first ceiling-surface blowoff port 711 as shown in FIG. 9, and operates the drive motor 52 of the blowing machine 54, the heater 41, the induction heating device 42 (see FIG. 2), and the turntable drive motor 91. Specifically, in this case, the sirocco fan 51*a* is rotated by the drive motor 52 at a high rate, so that hot air is blown out via the first ceiling-surface blowoff port 711 at a speed of 50 km/h or more. This control permits a hot-air-impact cooking method, and thus permits quick preparation of roasted chicken.

On the other hand, in a case where sponge cake is prepared on the cooking device 1 of this embodiment, a double-stage rack (not illustrated) is placed on the turntable 95 inside the heating chamber 3, then a lump of dough is put on each stage of the double-stage rack, and then, from the menu items displayed on the operation panel 81 (see FIG. 1), the one for sponge cake is selected. In response to this instruction, the controller 82 (see FIG. 2) instructs the damper device 83 to switch the blowoff port of the blowing machine 54 to the second ceiling-surface blowoff port 712 as shown in FIG. 10, and operates the drive motor 52 of the blowing machine 54, the heater 41, the induction heating device 42 (see FIG. 2), and the turntable drive motor 91. Specifically, in this case, the sirocco fan 51*a* is rotated by the drive motor 52 at a low rate, so that hot air is blown out via the second ceiling-surface blowoff port 712 at a speed of 50 km/h or less. This control permits a double-stage hot-wind-circulation cooking method, and thus permits preparation of fluffy sponge cake on each stage of the double-stage rack.

The rotation rate of the drive motor 52 of the blowing machine 54 is variable, and therefore cooking can be performed at a wind speed other than those specifically given above. The heater 41 and the induction heating device 42 can be turned on and off, and the amounts of heat generated by them can be adjusted. This make it possible to realize different cooking methods suitable for the cooking of various cooking targets.

Constructed as described above, the cooking device 1 of this embodiments offers the same effects as the cooking device 1 of the first embodiment. In addition, in this embodiment, the blowing machine 54 is built with a sirocco fan 51*a* and a spiral fan casing 53*b*. This helps increase blow efficiency and reduce noise. Furthermore, the fan drive motor 52 is a motor that rotates only in one direction. This helps increase efficiency and reduce cost. Moreover, the wind speeds blown out via the first and second ceiling-surface blowoff ports 711 and 712 can be adjusted simply by controlling the rotation rate of the blowing machine 54. This makes it possible to very easily adjust the wind speeds blown out via the first and second ceiling-surface blowoff ports 711 and 712.

Figure 11:
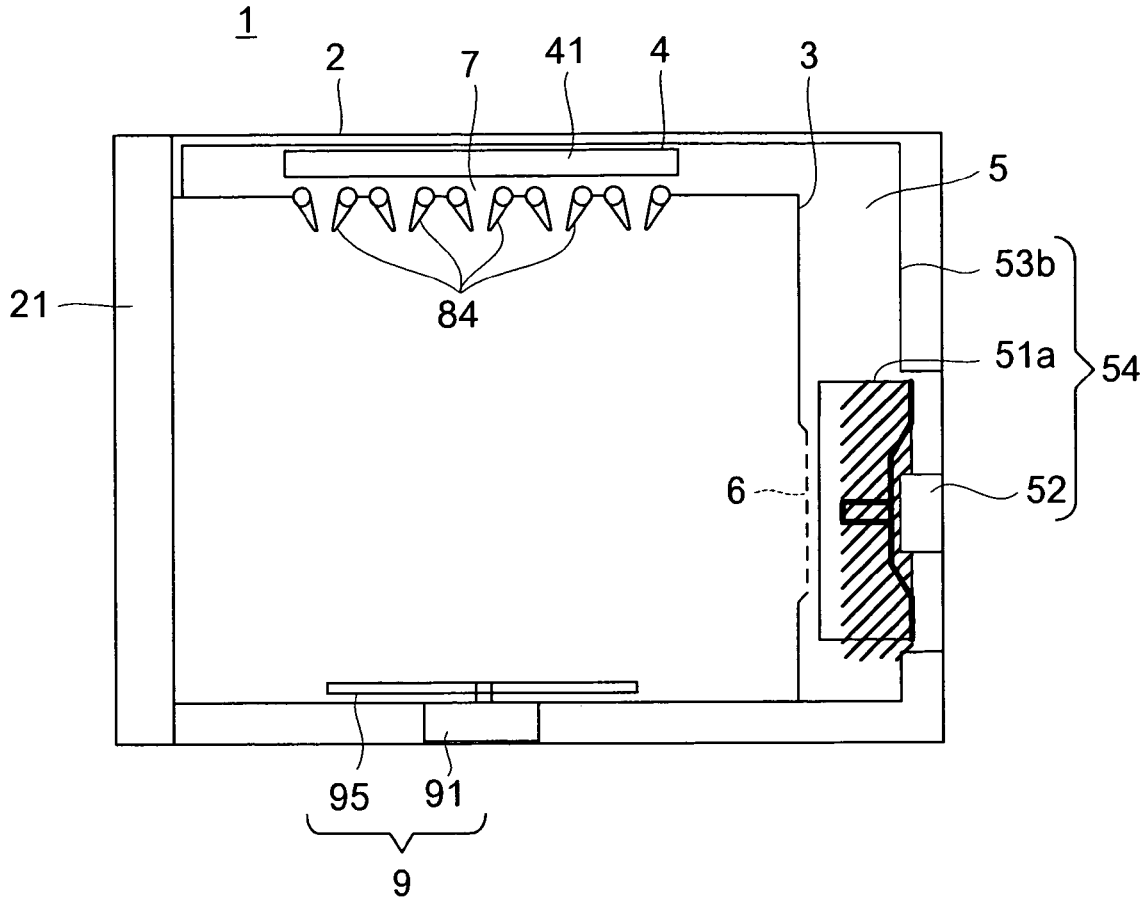
FIG. 11 is a side sectional view showing the construction of the cooking device of a sixth embodiment of the invention, with the thermally insulated door opened.

Next, a sixth embodiment of the invention will be described. FIG. 11 is a side sectional view showing the construction of the cooking device 1 of the sixth embodiment. The cooking device 1 of this embodiment differs from the cooking device 1 of the fifth embodiment shown in FIGS. 9 and 10 in the following respects.

In the ceiling surface of the heating chamber 3, there is provided a blowoff port 7 provided with a throttling device 84. The air sucked in via the suction port 6 by the blowing machine 54 is heated by the heater 41, and is blown out via the blowoff port 7 into the heating chamber 3. Meanwhile, the wind speed of the air thus blown out is adjusted by the throttling device 84. In other respects, the cooking device 1 of this embodiment is constructed in the same manner as the cooking device 1 of the fifth embodiment, and therefore such components as are common to the two embodiments are identified with the same reference numerals, and their explanations will not be repeated.

In the cooking device 1 constructed as described above, when the user puts a cooking target on a meshed rack (not illustrated) placed on the turntable 95 and enters instructions via the operation panel 81 (see FIG. 1), according to the instructions entered via the operation panel 81, the controller 82 (see FIG. 2) provided as the controlling means 8 (see FIG. 1) selects a suitable cooking method from a plurality of preprogrammed cooking methods, and controls the operation of the drive motor 52 of the blowing machine 54, the heater 41, the induction heating device 42 (see FIG. 2), and the turntable drive motor 91 to perform the cooking of the cooking target.

For example, in a case where roasted chicken is prepared on the cooking device 1 of this embodiment, a meshed rack (not illustrated) is placed on the turntable 95 inside the heating chamber 3, then a chunk of chicken is put on the meshed rack, and then, from the menu items displayed on the operation panel 81 (see FIG. 1), the one for roasted chicken in selected. In response to this instruction, the controller 82 (see FIG. 2) operates the throttling device 84 in such a way as to reduce the area of the blowoff port 7, and operates the drive motor 52 of the blowing machine 54, the heater 41, the induction heating device 42 (see FIG. 2), and the turntable drive motor 91. Specifically, in this case, the sirocco fan 51*a* is rotated by the drive motor 52 at a high rate, so that hot air is blown out via blowoff port 7 at a speed of 50 km/h or more. This control permits a hot-air-impact cooking method, and thus permits quick preparation of roasted chicken.

On the other hand, in a case where sponge cake is prepared on the cooking device 1 of this embodiment, a double-stage rack (not illustrated) is placed on the turntable 95 inside the heating chamber 3, then a lump of dough is put on each stage of the double-stage rack, and then, from the menu items displayed on the operation panel 81 (see FIG. 1), the one for sponge cake is selected. In response to this instruction, the controller 82 (see FIG. 2) operates the throttling device 84 in such a way as to increase the area of the blowoff port 7, and operates the drive motor 52 of the blowing machine 54, the heater 41, the induction heating device 42 (see FIG. 2), and the turntable drive motor 91. Specifically, in this case, the sirocco fan 51*a* is rotated by the drive motor 52 at a low rate, so that hot air is blown out via the blowoff port 7 at a speed of 50 km/h or less. This control permits a double-stage hot-wind-circulation cooking method, and thus permits preparation of fluffy sponge cake on each stage of the double-stage rack.

The rotation rate of the drive motor 52 of the blowing machine 54 is variable, and therefore cooking can be performed at a wind speed other than those specifically given above. The heater 41 and the induction heating device 42 can be turned on and off, and the amounts of heat generated by them can be adjusted. This make it possible to realize different cooking methods suitable for the cooking of various cooking targets.

Constructed as described above, the cooking device 1 of this embodiments offers the same effects as the cooking device 1 of the fifth embodiment. In addition, in this embodiment, the construction is further simplified. This helps reduce the number of components, and helps further reduce cost.

Figure 12:
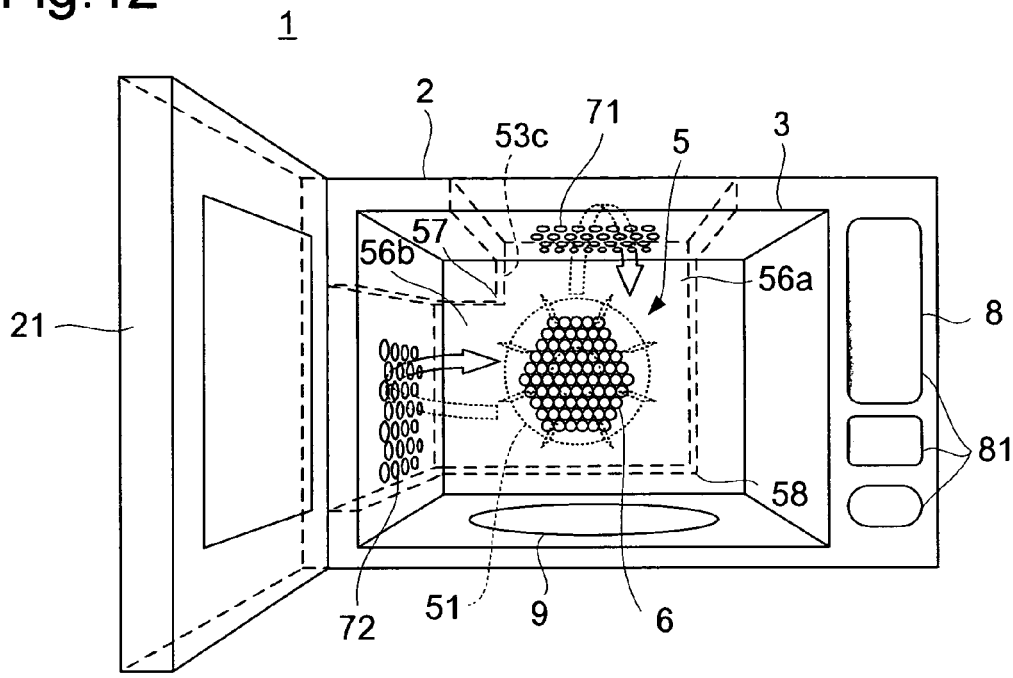
FIG. 12 is a perspective view showing an outline of the construction of the cooking device of a seventh embodiment of the invention as seen from the surface in which the opening of the heating chamber is formed, with the thermally insulated door opened.

Next, a seventh embodiment of the invention will be described. FIG. 12 is a perspective view showing an outline of the construction of the cooking device 1 of the seventh embodiment as seen from the surface (front surface) in which the opening of the heating chamber is formed, with the thermally insulated door opened 21. This figure is partially made see-through to show the air-blow passages, for easy understanding of how air flows.

Now, with reference to FIG. 12, an outline of the construction of the cooking device 1 will be described. The cooking device 1 is composed of: a box-shaped member 2 that has the shape of a rectangular parallelepiped; a heating chamber 3 that is formed inside the box-shaped member 2, that is thermally insulated from the box-shaped member 2 by an insulating material (not illustrated), and that permits a cooking target to be placed therein; heating means 4 (see FIG. 13) that heats the cooking target; blowing means 5 that sends the hot air heated by the heating means into the heating chamber 3; controlling means 8 (see FIG. 13) that controls the heating means 4 and the blowing means 5; and rotating means 9 that permits the cooking target to be placed thereon directly or via a rack placed thereon and that permits the cooking target to be rotated.

It should be noted that, in the present specification, the following expressions are used to refer to the relevant directions. The front surface of the heating chamber 3 refers to the surface thereof in which the opening of the heating chamber 3 is formed, the front surface of the heating chamber 3 refers to the surface thereof in which the opening of the heating chamber 3 is formed, the rear surface of the heating chamber 3 refers to the surface thereof that is opposite to the front surface thereof. The direction from the rear surface to the front surface is referred to as the frontward direction, and the direction from the front surface to the rear surface is referred to as the rearward direction. The floor surface of the heating chamber 3 refers to the surface thereof on which the cooking target is placed, and the ceiling surface of the heating chamber 3 refers to the surface thereof that faces that floor surface thereof. The direction from the floor surface to the ceiling surface is referred to as the upward direction, and the direction from the ceiling surface to the floor surface is referred to as the downward direction.

Figure 13:
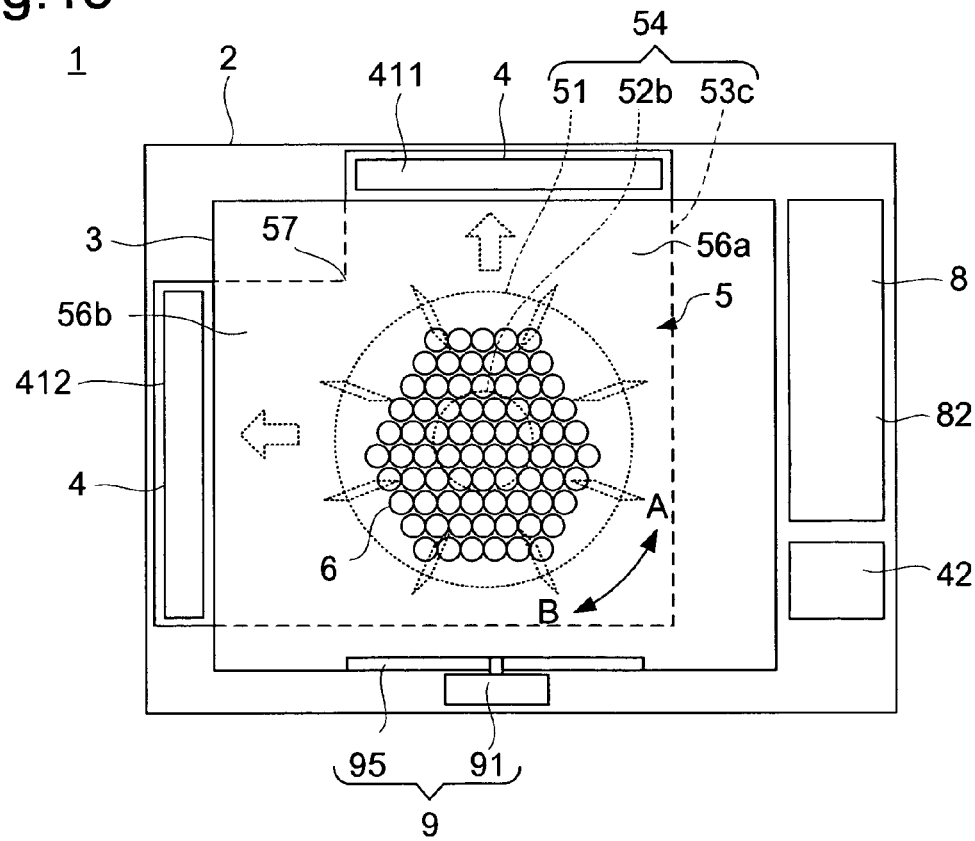
FIG. 13 is a sectional view of the same cooking device.

Now, with reference to FIGS. 12 and 13, the heating device of this embodiment will be described in detail. FIG. 13 is an outline sectional view showing an up-down-direction section of the cooking device 1 of this embodiment taken substantially at the center thereof in the front-rear direction.

In the cooking device 1, behind the rear surface 3 of the heating chamber 3 but in front of the rear surface of the box-shaped member 2 is provided the blowing means 5. In a part of the rear surface of the heating chamber 3 facing the blowing means 5, there is formed an opening (hereinafter referred to as the suction port 6) consisting of a plurality of punched holes via which air is sucked in when the blowing means 5 is operated.

The blowing means 5 is provided with a centrifugal fan 51 and a reversible motor 52*b* that can rotate in the forward and backward directions. The centrifugal fan 51 is pivoted on the reversible motor 52*b*.

Moreover, behind the heating chamber 3 but in front of the rear surface of the box-shaped member 2, there is provided a two-way branch fan casing 53*c* that branches in two directions, namely into an upper air-blow passage 56*a* through which the wind sent from the blowing means 5 is guided upward and a side air-blow passage 56*b* through which the wind is guided sideways (in FIG. 12, leftward as seen from the viewer facing it).

The shape of the two-way branch fan casing 53*c* may vary; specifically, it may have, at the branch point 57 thereof at which the upper and side air-blow passages 56*a* and 56*b* branch off, an angle of, for example, substantially 90 degrees as shown in FIG. 12, or an acute angle (see FIG. 14), or, though not illustrated, an obtuse angle. In the present specification, the shape of the air-blow passage is referred to as "L-shaped" when it has an angle of 90 degrees at the branch point as described above and collectively as "angled" when it has an acute or obtuse angle.

In the ceiling surface of the heating chamber 3, there is formed a ceiling-surface blowoff port 71 that communicates with the upper air-blow passage 56*a* and that consists of a plurality of through holes each, for example, 11 mm across. In a side surface of the heating chamber 3, there is provided a side-surface blowoff port 72 that communicates with the side air-blow passage 56*b* and that consists of a plurality of punched holes.

On the front surface of the cooking device 1, at the side opposite to the side-surface blowoff port 72, there is provided an operation panel 81 that accepts instructions for cooking from the user. Moreover, behind the operation panel 81, in the space between the surface of the heating chamber 3 opposite to the surface thereof in which the side-surface blowoff port 27 is formed and the side surface of the box-shaped member 2, there is provided controlling means 8.

Here, the wind sucked in via the suction port 6 is branched by the two-way branch fan casing 53*c* into a part that is sent to the upper air-blow passage 56*a* and a part that is sent to the side air-blow passage 56*b*.

The wind that passes through the upper air-blow passage 56*a* absorbs heat from and is thereby heated by an upper heater 411 that is heated by being energized, and is then blown out at a speed of 65 km/h or more via the ceiling-surface blowoff port 71 at the cooking target. The wind that passes through the side air-blow passage 56*b* absorbs heat from and is thereby heated by a side heater 412 that is heated by being energized, and is then blown out at a speed of 30 km/h or less via the side-surface blowoff port 72 at the cooking target.

This control permits a hot-air-impact cooking method, and thus permits quick preparation of roasted chicken. The induction heating device 42 may be energized to assist cooking.

On the other hand, in a case where sponge cake is prepared on the cooking device 1 of this embodiment, a placement rack (not illustrated) is placed in an upper and a lower part inside the heating chamber 3, then a lump of dough is put on each rack of the placement rack, and then, from the menu items displayed on the operation panel 81, the one for sponge cake is selected. In response to this instruction, the controller 82 operates the drive motor 52 of the blowing machine 54, the side heater 412, the induction heating device 42, and the turntable drive motor 91, and, as necessary, operates the upper heater 411. Specifically, in this case, the centrifugal fan 51 is rotated by the reversible motor 52*b* in the direction indicated by arrow B in FIG. 2 at a lower rate than when rotated in the direction indicated by arrow A as described above.

When the reversible motor 52*b* is rotated in this way, the wind volume and wind speed blown out via the ceiling-surface blowoff port 71 are lower than the wind volume and wind speed blown out via the side-surface blowoff port 72. Thus, hot air is blown out via the ceiling-surface blowoff port 71 at a speed of 30 km/h or less, and hot air is blown out via the side-surface blowoff port 72 at a speed of 40 km/h or less. This control permits preparation of fluffy sponge cake on both of the upper and lower stages. That is, in a case where a placement rack having a plurality of stages is used, cooking can be performed uniformly irrespective of on which stage a cooking target is put.

The above-described two cooking methods having utterly different effects are realized by individually controlling and appropriately selecting from or combining together the wind speeds at the plurality of blowoff ports formed in different wall surfaces of the heating chamber.

That is, the two blowoff ports may be arranged in a different manner than in the cooking device 1 of this embodiment; for example, they may be arranged in the ceiling and rear surfaces, in the ceiling and front surfaces, in the floor and side surfaces, in the floor and rear surfaces, or in the floor and front surfaces. It is possible even to arrange at least one of two or more blowoff ports in a wall surface different from the wall surface in which the other blowoff ports are formed. With any of these arrangements, it is possible to obtain almost the same effects. Accordingly, although the two blowoff ports are arranged in the ceiling and side surfaces in the cooking device 1 of this embodiment, this is not meant to limit in any way how many blowoff ports should be formed and where they should be arranged.

It is preferable, however, that the side-surface blowoff port 72 and the controlling means 8 and/or the operation panel 81 be arranged so as to face each other as described above. This prevents the controlling means 8 and/or operation panel 81 from being influenced by the hot wind passing through the side air-blow passage 56*b*, and thus eliminates the need to use highly heat-resistant components in the controlling means 8 and/or the operation panel 81.

The rotation rate of the reversible motor 52*b* of the blowing machine 54 may be made variable. This makes it possible to perform cooking at a wind speed other than those specifically given above. The upper and side heaters 411 and 412 and the induction heating device 42 may be so designed that they can be turned on and off and the amounts of heat generated by them can be adjusted. This make it possible to realize different cooking methods suitable for the cooking of various cooking targets.

The blowing machine 54 may use, as the centrifugal fan 51, a sirocco fan, radial fan, or turbo fan, or, to make the best of a limited space or out of other consideration, an axial-flow fan, oblique-flow fan, or through-flow fan. The blowing machine 54 may be replaced with a blower.

Figure 14:
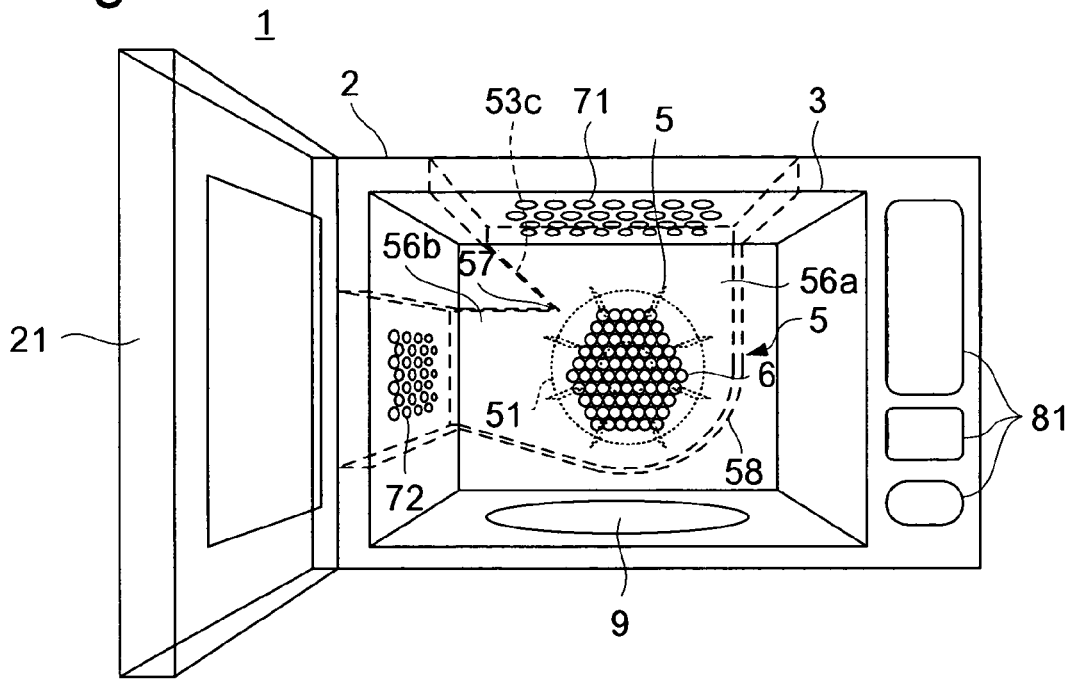
FIG. 14 is a perspective view showing an outline of the construction of the cooking device of an eighth embodiment of the invention as seen from the surface in which the opening of the heating chamber is formed, with the thermally insulated door opened.

The shape of the part of the two-way branch fan casing 53 diagonal to the branch point 57 may be rectangular as shown in FIG. 13, spiral, or arc-shaped (see FIG. 14).

The punched holes of the suction port 6 and the side-surface blowoff port 72 may be given any other diameter than 5 mm to obtain the same effects. Those holes do not have to be formed as punched holes, but may be formed as slits or a net. The same is true with the ceiling-surface blowoff port 71; that is, the holes there may be given any other diameter than 11 mm to obtain the same effects.

Figure 15:
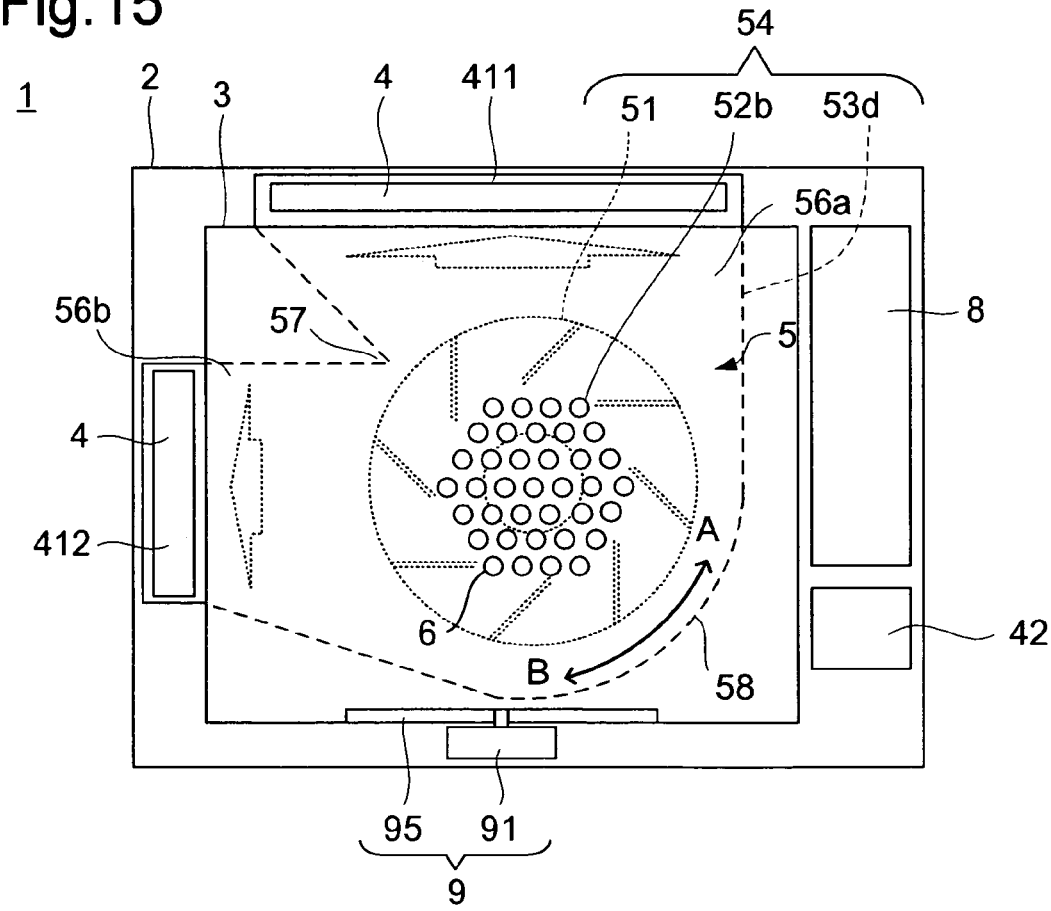
FIG. 15 is a sectional view of the same cooking device.

Next, an eighth embodiment of the invention will be described. FIG. 14 is a perspective view showing an outline of the construction of the cooking device 1 of the eighth embodiment as seen from the surface (front surface) in which the opening of the heating chamber 3 is formed, with the thermally insulated door opened 21. This figure is partially made see-through to show the air-blow passages, for easy understanding of how air flows. FIG. 15 is an outline sectional view showing an up-down-direction section of the cooking device 1 of this embodiment taken substantially at the center thereof in the front-rear direction.

The cooking device 1 of this embodiment differs from the cooking device 1 of the seventh embodiment shown in FIGS. 12 and 13 in the following respects. The cross-sectional area of the upper air-blow passage 56*a* near the centrifugal fan 51 is larger than the cross-sectional area of the side air-blow passage 56*b* near the 51. Moreover, the upper air-blow passage 56*a* becomes increasingly large along the air-blow direction. In other respects, the cooking device 1 of this embodiment is constructed in the same manner as the cooking device 1 of the seventh embodiment, and therefore such components as are common to the two embodiments are identified with the same reference numerals, and their explanations will not be repeated.

Constructed as described above, the cooking device 1 of this embodiments offers, in addition to the effects offered by the cooking device 1 of the seventh embodiment, the following effects.

When the centrifugal fan 51 is rotated by the reversible motor 52B at a high rate in the direction indicated by arrow A shown in FIG. 15, the wind volume that passes through the air-blow passage 56*a* becomes far higher than the wind volume that passes through the air-blow passage 56*b*. Moreover, since the air-blow passage 56*a* becomes increasingly large along the air-blow direction, it functions as a so-called diffuser by converting the kinetic energy of the flowing wind into a static pressure. This greatly augments the wind guided upward from the heater 41 as compared with the same wind in the cooking device 1 of the seventh embodiment. This enhances the performance of the centrifugal fan 51, and thus, even if the rotation rate of the centrifugal fan 51 is made lower than in the cooking device 1 of the seventh embodiment, it is possible to blow out hot air via the ceiling-surface blowoff port 71 at a speed of 65 km/h or more and simultaneously blow out hot air via the side-surface blowoff port 72 at a speed of 30 km/h or less.

This helps greatly reduce the noise that is produced during the cooking of a chunk of meat such as chicken to be roasted, or pizza, or the like. Alternatively, by setting the rotation rate of the centrifugal fan 51 at a rate equivalent to that at which it is set in the cooking device 1 of the fist embodiment, it is possible to blow out hot air via the ceiling-surface blowoff port 71 at a speed of 80 km/h or more and simultaneously blow out hot air via the side-surface blowoff port 72 at a speed of about 40 km/h. This helps greatly reduce the time required for the cooking of a chunk of meat such as chicken to be roasted, or pizza, or the like.

On the other hand, when the centrifugal fan 51 is rotated by the reversible motor 52*b* at a low rate in the direction indicated by arrow B shown in FIG. 15, although the wind volume that passes through the air-blow passage 56*a* is low, since the air-blow passage 56*a* becomes increasingly large along the air-blow direction, the wind is separated from the wall surface, and thus a so-called choking phenomenon occurs. This diminishes the wind guided upward from the heater 41 as compared with the same wind in the cooking device 1 of the seventh embodiment.

Thus, even when hot air is blown out via the side blowoff port 72 at a speed of 40 km/h or less, it is possible to reduce the wind speed via the ceiling blowoff port 71 to about 20 km/h or less. This makes it possible to more appropriately cook sponge cake or the like, i.e., a cooking target that is cooked by producing bubbles therein, or a cooking target that contains much air from the beginning.

Figure 16:
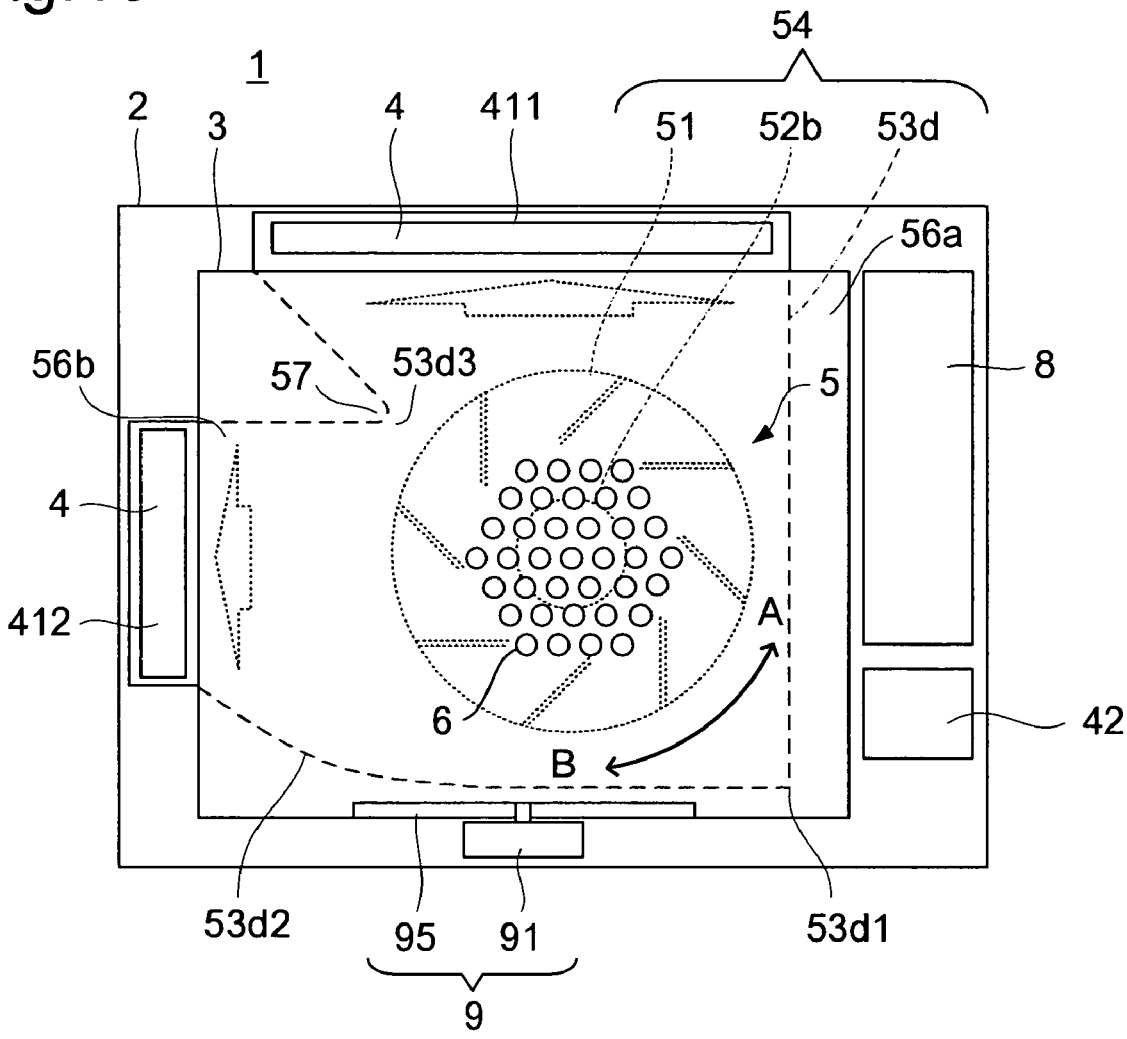
FIG. 16 is a sectional view showing the construction of the heating device of a ninth embodiment of the invention.
Figure 17:
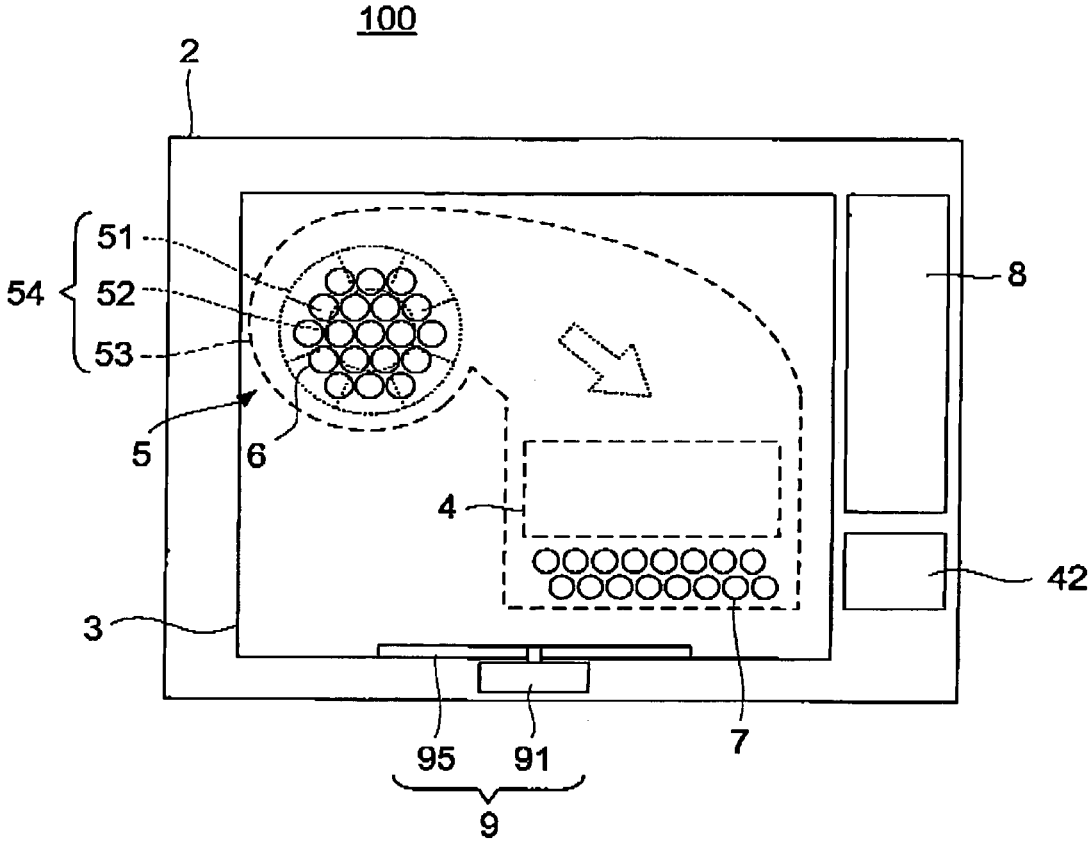
Fig.17 Prior Art
FIG. 17 is a sectional view showing the construction of a conventional heating device.

Next, a ninth embodiment of the invention will be described. The seventh and eighth embodiments described above can be further modified. FIG. 16 shows such a modified example. FIG. 16 is an outline sectional view showing an up-down-direction section of the cooking device 1 of the eighth embodiment as seen from the front surface and taken substantially at the center thereof in the front-rear direction, and is partially made see-through to show the air-blow passages.

The two-way branch fan casing 53*c* may be shaped like the two-way branch fan casing 53*d* shown in FIG. 16. Specifically, the lower right-hand part 53*d*1 of the two-way branch fan casing 53*d* may be cornered, and the lower left-hand part 53*d*2 of the two-way branch fan casing 53*d* may bulge in a direction away from the centrifugal fan 51, or may cave in.

The upper left-hand part 53*d*3 of the two-way branch fan casing 53*d*, i.e., the part thereof (the so-called tongue-shaped part) at the edge of the branch point 57 at which the air-blow passage branches in two directions, may be round where it faces the centrifugal fan 51. This helps further reduce cooking noise.

INDUSTRIAL APPLICABILITY

As described above, according to the present invention, it is possible to realize, on a single cooking device, a cooking method suitable for the cooking of a chunk of meat such as chicken to be roasted, or pizza, or the like, i.e., a cooking target of which the cooking is not interfered with by the wind pressure of a hot air impact and a cooking method suitable for the cooking of sponge cake or the like, i.e., a cooking target that is cooked by producing bubbles therein, or a cooking target that contains much air.

The invention claimed is:

1. A cooking device comprising a box-shaped member, a heating chamber that is formed inside the box-shaped member to permit a cooking target to be placed therein, a first and a second heating device for heating the cooking target placed in the heating chamber, a reversibly rotatable fan for introducing hot air heated by the first and second heating devices into the heating chamber, a controller for controlling the first and second heating devices and the fan, a suction port formed in a wall surface of the heating chamber, a first and a second blowoff port formed respectively in wall surfaces of the heating chamber that are different from each other and different from the wall surface in which the suction port is formed, and a branch air-blow passage that branches air that has been sucked in via the suction port by rotation of the fan in a first blowoff port direction and a second blowoff port direction, wherein cooking is performed by a plurality of cooking methods as a result of the controller adjusting individually a rotation direction and a rotation rate of the fan, and thereby adjusting individually a wind volume of the air heated by the first heating device and introduced via the first blowoff port into the heating chamber by the fan and a wind volume of the air heated by the second heating device and introduced via the second blowoff port into the heating chamber by the fan.

2. The cooking device according to claim 1, wherein the first blowoff port is formed in a surface that faces a surface on which the cooking target is placed, the second blowoff port is formed in another surface, and the air-blow passage that connects the suction port to the first blowoff port and the air-blow passage that connects the suction port to the second blowoff port branch from the fan in two directions so as to each describe an L-like or otherwise angled shape.

3. The cooking device according to claim 2, wherein the air-blow passage that connects the suction port to the first blowoff port is formed so as to run from the fan in a direction in which is located the surface that faces the surface on which the cooking target is placed.

4. The cooking device according to claim 3, wherein the air-blow passage that connects the suction port to the first blowoff port has a larger cross-sectional area than the other air-blow passage.

5. The cooking device according to claim 1, wherein the plurality of cooking methods include two cooking methods, namely a hot-air-impact method and a hot-wind-circulation method.

6. The cooking device according to claim 1 or 5, wherein the heating device uses a first cooking method and a second cooking method, the first cooking method is one whereby hot air is blown out via the first blowoff port at a speed of 65 km/h or more and hot air is blown out via the second blowoff port at a speed of 30 km/h or less, and the second cooking method is one whereby hot air is blown out via the first blowoff port at a speed of 30 km/h or less and hot air is blown out via the second blowoff port at a speed of 40 km/h or less.

* * * * *